United States Patent [19]

Lee

[11] 4,019,772

[45] Apr. 26, 1977

[54] HOSPITAL TROLLEYS

[75] Inventor: Norman John Lee, London, England

[73] Assignee: Matburn (Holdings) Limited, London, England

[22] Filed: Aug. 27, 1975

[21] Appl. No.: 608,171

[30] Foreign Application Priority Data

Feb. 7, 1975 United Kingdom ..... 5289/75

[52] U.S. Cl. ..... 296/20; 214/1 D; 5/81 B

[51] Int. Cl.[2] ..... A61G 1/00

[58] Field of Search ..... 296/20; 5/81 R, 81 B, 5/81 C, 62, 86; 214/1 D

[56] References Cited

UNITED STATES PATENTS

| | | | |
|---|---|---|---|
| 3,902,204 | 9/1975 | Lee | 5/81 B |
| 3,917,076 | 11/1975 | Campbell | 214/1 D |

*Primary Examiner*—Philip Goodman
*Attorney, Agent, or Firm*—William R. Liberman

[57] ABSTRACT

A hospital patient transfer system is provided by a transfer trolley with a wheeled undercarriage. A lift ram is movable up and down with respect to the undercarriage and can also tilt about a horizontal pivot on the undercarriage. The lift ram supports an upper frame so that it can be raised, lowered or tilted in response to varying positions of the ram. The upper frame has parallel end pieces spaced from each other by a distance such that a hospital bed, operation table or trolley can be received between them. The end pieces of the upper frame are provided with lift members which can be raised or lowered with respect to the end pieces. A flat rectangular patient-supporting element can removably be inserted in opposed tracks in the end pieces so that it may be positioned below a stretcher supported by the lift members when they are in a raised position. The lift members can then be lowered to enable the weight of the patient to be taken by the patient supporting element.

3 Claims, 5 Drawing Figures

HOSPITAL TROLLEYS

BACKGROUND TO THE INVENTION

Patient transfer system by which a patient can be transferred to and from a bed or a stretcher vehicle (herein called a "trolley") and a hospital operation table without necessitating any lifting of the patient by the hospital staff are known. An object of the present invention is to provide an improved such system.

SUMMARY OF THE INVENTION

A hospital transfer trolley comprises a wheeled undercarriage; a lift ram mounted on the undercarriage and movable up and down with respect to the undercarriage, the said lift ram being also capable of tilting about a horizontal pivot; an upper frame mounted on the lift ram so that it can be raised, lowered or tilted in response to varying positions of the ram, the upper frame having parallel end pieces spaced from each other by a distance such that a hospital bed, operation table or trolley can be received between them, the end pieces being provided with lift members which can be raised or lowered with respect to the end pieces; a patient supporting element which can be inserted in opposed tracks in the end pieces so that it is movable to and from a position in which it is supported below a stretcher or the like supported by the lift members in a raised position; power means for raising, lowering and tilting the ram, and power means for raising and lowering the end pieces. In operation, the patient supporting element may be positioned below a stretcher supported on raised lift members. The lift members can then be lowered so that the weight of the patient is taken by the patient supporting element.

The transfer trolley of the present invention is very useful in hospital work as there are many periods within a theatre area of a hospital when patients are required to wait several times between stations in their travel to and from an operating table. After an operation a patient can be permitted to recover, if desired, on the trolley. The patient supporting member can include a mattress which makes it easier to keep a patient warm and comfortable since blankets and other coverings can be placed on the mattress surface before a stretcher carried by the lift members is lowered on the mattress. The trolley is primarily intended for handling patient within the theatre area of a hospital, but it can also be used for collecting patients from an accident unit or a ward in which case the trolley can be wheeled to a position in which the end pieces enclose each end of the bed.

DESCRIPTION OF A PREFERRED EMBODIMENT

Figure 1:
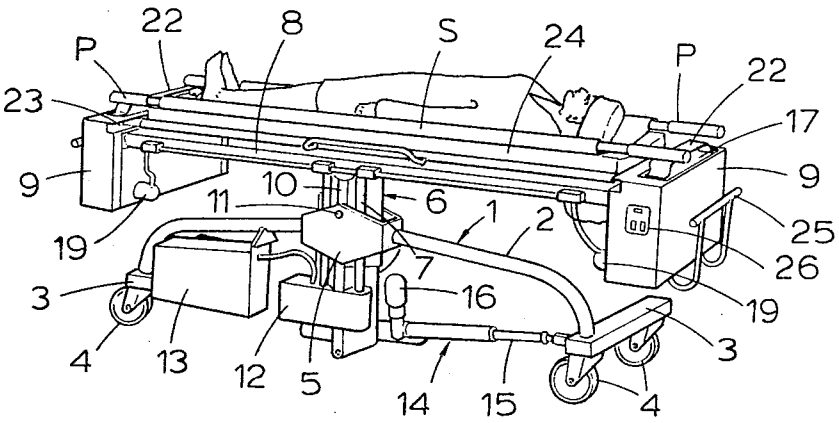
FIG. 1 is a perspective view of a transfer trolley.

In the illustrated embodiment of the invention, a hospital transfer trolley comprises a chassis frame or undercarriage generally designated 1 in the form of an elongated beam 2 which provides the lower part of the long side of the trolley and two substantially parallel end pieces 3 on which the beam is supported to provide a U-shaped three-sided undercarriage. The undercarriage 1 is mounted on castor wheels 4. The beam 2 conveniently comprises two tubular metal spars, one end of each of which is secured to one of the end pieces 3 and the other ends of each of which is secured to a central rectangular frame 5 (hereinafter called a column support) which is made of sheet metal, or as a casting, and is open at the top and bottom.

Figure 4:
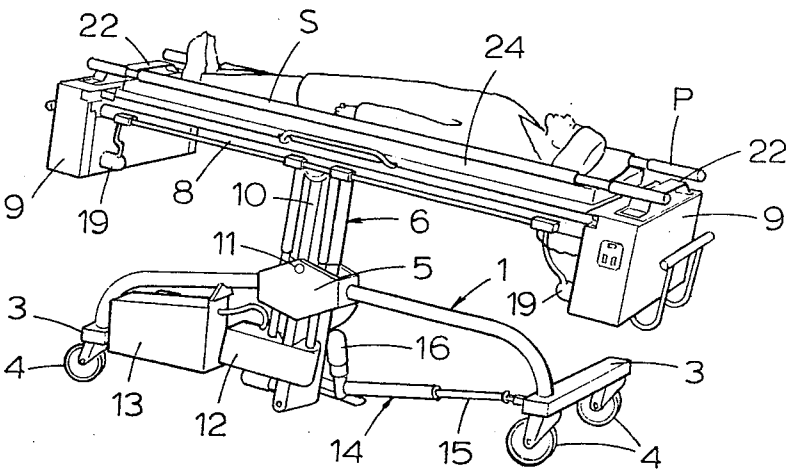
Figure 5:
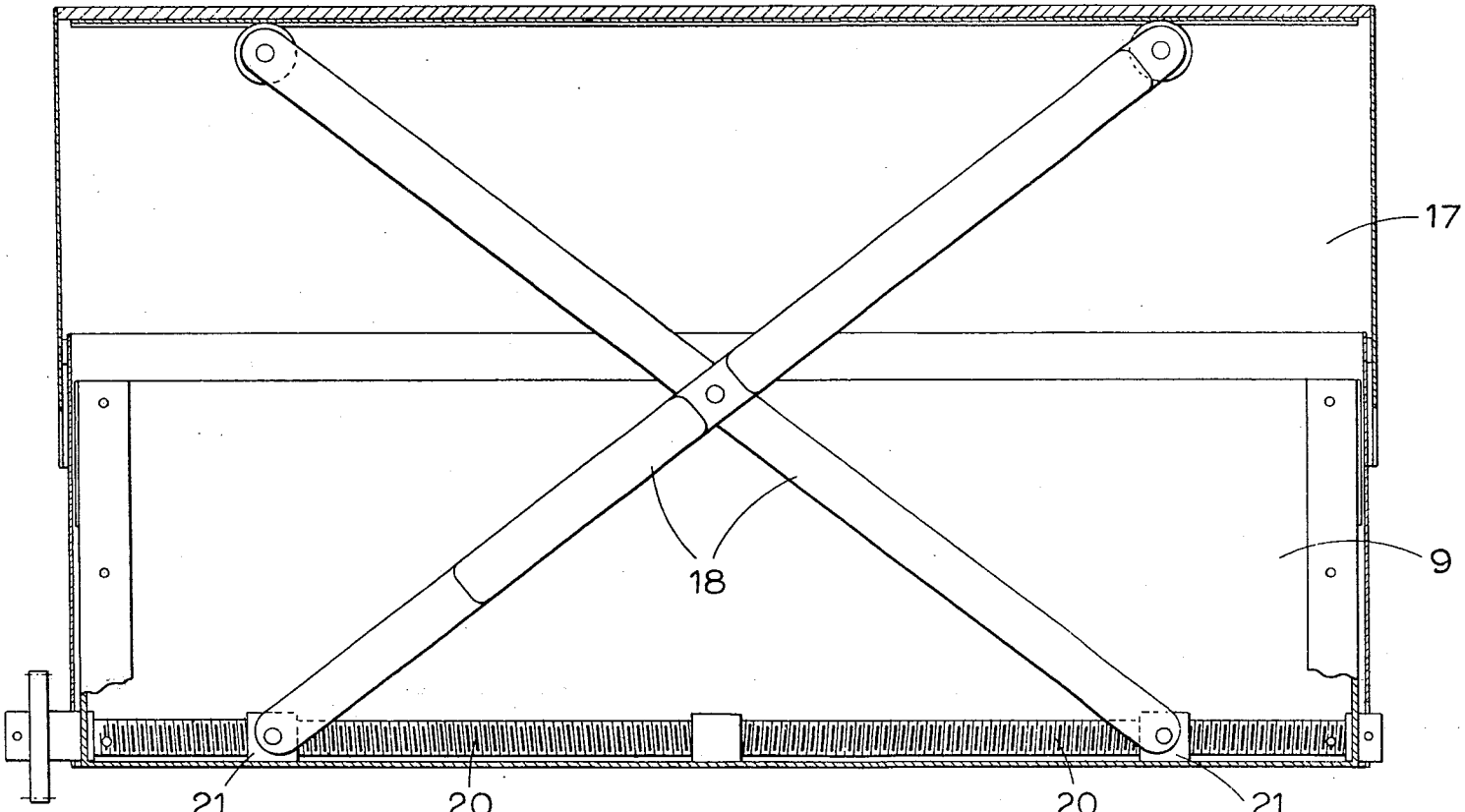
FIG. 5 is a detail view illustrating a lifting mechanism of the trolley.

Mounted in the column support 5 is a vertically disposed support column generally designated 6 including a lift ram 7, the top of which is secured to the centre of a side beam 8 of an upper frame. Two parallel upper end pieces 6 extend from the ends of the upper side beam providing a U-shaped frame generally coincidental with the U-shaped undercarriage 1. The support column 6 comprises an outer column housing 10 which is mounted in the column support 5 for movement about a horizontal pivot axis 11 and the lift ram 7 is movable within this outer column housing 10. The lift ram 7 can be reciprocated upwards and downwards with respect to the fixed outer support column 6 and therefore with respect to the undercarriage 1 also, by means of a suitable electric motor 12 which is carried by the undercarriage 1. The power to actuate the electric motor 12 is supplied by storage battery 13 also carried by the undercarriage 1. The outer fixed column housing 10 of the support column 6 extends below the elongated beam 2 of the undercarriage 1 and the lower end of the support column 6 is connected to one end of an extendable brace or actuator 14 the other end of which is fixed to one of the end pieces 3 of the undercarriage 1. The brace 14 comprises an outer tubular member within which an inner member or ram 15 is reciprocated thereby lengthwise to lengthen or shorten the brace. A change in the length of the brace 14 causes the support column 6 to swing about its pivot 11 with the column support 5 and since the upper frame 8 is fixed to the top of the lift ram 7, such movement of the support column 6 will result in a tilt of the upper frame 8, as shown in FIG. 4.

Extension or retraction of the brace 14 is produced by an electric motor 16 carried by the undercarriage 1, the electric motor 16 rotating a screw-threaded mechanism (not shown) in the outer tube to extend or retract the inner member or ram. Micro-switches are positioned in the column support so as to be engageable when the support column returned from the tilted position to an upright position, i.e., to a position in which the upper frame lies parallel to the support frame.

The end pieces 9 of the upper U-shaped frame include sheet metal housings. At the top of each housing is a stretcher lift member 17. Each lift member 17 is raised or lowered within the housing by means of a lazy tong or scissor mechanism inside the respective housing. Each lazy tong or scissor 18 is opened or closed by means of a motor 19 also powered by the battery 12 in the undercarriage 1. The motor 19 rotates oppositely handed screw threads 20 in the housing when screw threads are rotatable in a pair of screw-threaded sockets 21, connected to the lazy tong or scissor mechanism to open or close the lazy tong or scissor and therefore raise or lower the members 17 as desired.

Each lift member 17 has means at the top for locating stretcher poles P or the like, such locating means being in the form of an inverted U-shaped bar 22 against the outer vertical elements of which the ends of the stretcher poles or the like can be placed. Thus, the U-shaped bar 22 prevents the stretcher poles P moving towards each other and the weight of the patient on the stretcher will be sufficient firmly to maintain the stretcher on the lift plates. The two end pieces 9 of the upper frame also have opposed horizontal tracks 23 on their facing aspects in which a "trolley top" or patient support 24 can be inserted. The patient support 24 is basically a flat rectangular bed member or support on which a mattress can be placed. The patient support may be translucent to X-rays. The leading side of the patient support or bed member 24 has wheels 25 at each end on the underside thereof and a foot is provided at the underside of each end of the trailing side of the patient support or bed member side. The support or bed member can easily be inserted in position on the upper U-shaped frame by engaging its wheels in the track and rolling them along the track, i.e. transversely of the trolley. When the support has been fully inserted in the tracks, the feet or the trailing side thereof will rest on the tracks behind stop blocks and which prevent the patient support, or bed members from rolling out of position. The tracks are located so that when the patient support or bed member is in position in the frame and a mattress is placed thereon and the lift plates are lowered to their lowermost position, the canvas of a stretcher supported on the lift plates will rest on the mattress.

Figure 3:
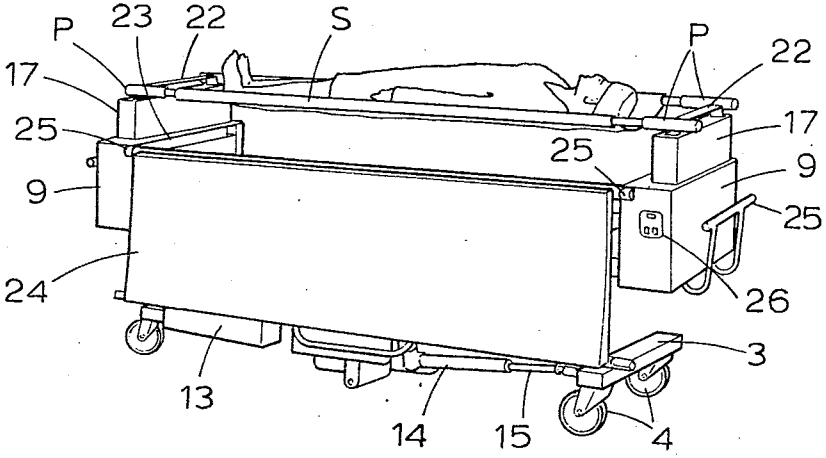

When the patient support or bed member is not in use it can be hung down to extend vertically at one side of the trolley as shown in FIG. 3.

Push handles 25 are fixed to each of the end pieces to assist in positioning the trolley.

Electric switches containing the operation of the various electric motors are mounted in a panel 26 on one of both of the end pieces.

Figure 2:
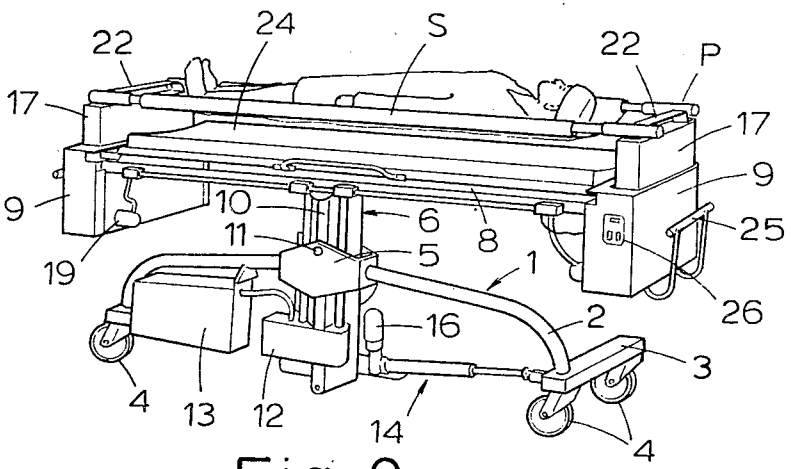
FIGS. 2, 3 and 4 are similar views showing parts of the trolley in alternative positions.

In use, the trolley of this invention is positioned at the barrier of an operation theatre area of a hospital where it can be engaged with a stretcher trolley which fits with its ends adjacent to and between the end pieces of the upper frame of the trolley. The lift members 17 are then raised to engage poles of a stretcher supporting a patient on the stretcher trolley and to lift the stretcher carrying the patient from the stretcher trolley. The patient support 224 with a mattress thereon is then positioned beneath the raised stretcher S (as shown in FIG. 2) and the lift members 17 are lowered to lower the patient on the stretcher S on to the mattress on the patient support or bed member 24 as shown in FIG. 1. The stretcher trolley is then removed. When the operation theatre staff is ready for the patient, the trolley is wheeled up to an operation table with the end pieces 9 lying outside the ends of the operation table. The lift members 17 are then again raised to raise the patient on the stretcher S above the patient support or bed member. The patient support or bed member is removed and the lift members are lowered to lower the patient onto the top of the operation table. The poles of the stretcher is then removed.

After treatment, the patient can be returned to the transfer trolley and can, if desired, be allowed to recover on the mattress supported on the patient support member of the trolley which may additionally be provided with cut sides and other facilities for recovery nursing.

The transfer trolley of the present invention is very useful in hospital work and there are many periods in a theatre area of a hospital when patients are required to wait several minutes between stages in the movement to and from the operation table. The transfer trolley provides a firm, comfortable and warm surface on which the patient may rest with much greater comfort and safety than is possible if suspended only on a canvas stretcher. After the operation, they can recover on a comfortable and well-padded mattress supported on the patient supporting member.

What is claimed is:

1. A hospital transfer trolley comprising a wheeled undercarriage; a left ram mounted on the undercarriage and movable up and down with respect to the undercarriage, said left ram being tiltable about a horizontal pivot; an upper frame mounted on the left ram and means to raise, lower, or tilt said frame selectively in response to varying positions of the ram, the upper frame having parallel end pieces sufficiently transversely spaced from each other to receive therebetween a hospital bed, operation table or trolley, opposed tracks in the end pieces, the end pieces being provided with lift members which can be raised or lowered with respect to the end pieces; a patient supporting element which can be inserted in the opposed tracks in the end pieces said element being movable to and from a position in which it is supported below a stretcher or the like supported by the lift members in a raised position; power means for selectively raising, lowering or tilting the ram, and power means for selectively raising and lowering the end pieces and wherein said undercarriage is U-shaped and comprises an elongated beam, two substantially parallel wheeled end pieces on which the ends of said beam are supported, a first central support column secured to said beam, a second support column pivotally mounted in said first support column and tiltable about a horizontal axis, a lift ram movable up and down within said second support column, an upper frame carried at the top of said lift ram, said upper frame including a side beam and parallel end pieces providing a U-shape generally coincidental with that of the undercarriage, and extendable braces connecting said pivotable support column with one of the end pieces of the undercarriage, and means for selectively extending or retracting said brace thereby to lift said second support column and also the upper frame about a horizontal axis.

2. A trolley as claimed in claim 1 wherein each of said parallel end pieces of said upper frame each comprise a lift member movable up and down within a housing, lazy tongs within said housing and connected with said lift member, oppositely handed screw threads in the housing, a pair of screw sockets connected to the lazy tongs, each of said oppositely handed screw threads being rotatable in one of said sockets thereby to open or close said lazy tongs and lower or raise said lift member, and locating means at the top of said lift member for locating stretcher holes thereon.

3. A trolley as claimed in claim 2 wherein said end pieces of said upper frame comprise opposed horizontal tracks on the facing aspects, said tracks being arranged to secure wheels of a flat rectangular removable bed member on which a patient can be supported, said tracks being so positioned that when said bed member is supported by the tracks it is below said locating means.

* * * * *